US010786009B2

(12) United States Patent
Huang et al.

(10) Patent No.: US 10,786,009 B2
(45) Date of Patent: Sep. 29, 2020

(54) ELECTRONIC CIGARETTE WITH AN ANTI-BLOWBACK MECHANISM

(71) Applicant: SHENZHEN YOUME INFORMATION TECHNOLOGY CO., LTD, Shenzhen, Guangdong (CN)

(72) Inventors: Furong Huang, Guangdong (CN); Liangzhi Huang, Guangdong (CN); Xiaoming Li, Guangdong (CN)

(73) Assignee: SHENZHEN YOUME INFORMATION TECHNOLOGY CO., LTD, Shenzhen, Guangdong (CN)

( * ) Notice: Subject to any disclaimer, the term of this patent is extended or adjusted under 35 U.S.C. 154(b) by 85 days.

(21) Appl. No.: 15/800,126

(22) Filed: Nov. 1, 2017

(65) Prior Publication Data

US 2019/0104765 A1 Apr. 11, 2019

(30) Foreign Application Priority Data

Oct. 9, 2017 (CN) ..... 2017 1 0928034

(51) Int. Cl.

| | |
|---|---|
| ***A24F 13/00*** | (2006.01) |
| ***A24F 17/00*** | (2006.01) |
| ***A24F 25/00*** | (2006.01) |
| ***A24F 47/00*** | (2020.01) |

(52) U.S. Cl.
CPC ..... *A24F 47/008* (2013.01)

(58) Field of Classification Search
CPC ..... A24F 47/008; A24F 47/002
USPC ..... 131/328, 329
See application file for complete search history.

(56) References Cited

U.S. PATENT DOCUMENTS

| | | | | |
|---|---|---|---|---|
| 9,247,773 | B2 * | 2/2016 | Memari | A24F 15/12 |
| 2014/0261495 | A1 * | 9/2014 | Novak, III | A24F 47/008 131/329 |
| 2015/0157054 | A1 * | 6/2015 | Liu | A24F 47/008 131/329 |
| 2015/0245656 | A1 * | 9/2015 | Memari | A24F 15/12 206/242 |
| 2016/0235120 | A1 * | 8/2016 | Liu | A24F 47/008 |
| 2017/0208863 | A1 * | 7/2017 | Davis | A24F 47/008 |
| 2018/0199627 | A1 * | 7/2018 | Bowen | A24F 47/008 |

* cited by examiner

*Primary Examiner* — Hae Moon Hyeon
(74) *Attorney, Agent, or Firm* — Hamre, Schumann, Mueller & Larson, P.C.

(57) ABSTRACT

The present invention provides an electronic cigarette including a cartridge and a main body detachably connected to the cartridge. An end of the cartridge is provided with a drip tip for air outflow, and the other end of the cartridge is provided with an electrode. A bottom of the cartridge has an air inlet. The main body includes a circuit board. A pneumatic switch is provided at an upper end of the main body fitting with the air inlet. The electrode contacts the circuit board for electric conduction when the cartridge is assembled with the main body. The pneumatic switch is turned on when an inhaling operation is performed, and the pneumatic switch is turned off when the inhaling operation is completed.

2 Claims, 3 Drawing Sheets

ELECTRONIC CIGARETTE WITH AN ANTI-BLOWBACK MECHANISM

CROSS-REFERENCE TO RELATED APPLICATIONS

This application claims priority to Chinese Patent Application No. 201710928034.0 filed on Oct. 9, 2017, the entire contents of which are hereby incorporated by reference.

TECHNICAL FIELD

The present invention relates to the field of electronic cigarette, and more particularly to an electronic cigarette having a function of anti-blowback.

BACKGROUND

The electronic cigarette is an electronic product that simulates the cigarettes, having the same appearance, smoke, taste and feeling as the cigarettes. The electronic cigarette is a product that transforms the nicotine into vapor for the user to inhale by means of atomization and the like. The World Health Organization (WHO) has studied on the electronic cigarettes and come to a clear conclusion that the electronic cigarettes are harmful to public health, and certainly not a way for smoking cessation, so that the control of electronic cigarettes must be strengthened to prevent the harms from adolescents and non-smokers.

Currently, the air intake passage of the known electronic cigarette is directly connected with the base of the main body of the battery. If a normal user operates it in incorrect ways such as blowing and the like, it is easy to make the pneumatic switch keep working continuously, and thus causing problems such as cotton within the electronic cigarette being over burnt without control, and the atomizer being damaged, or even worse the user being scalded due to the burnt cotton.

SUMMARY

The technical problem to be solved by the present invention is to provide an electronic cigarette which is provided with an anti-blowback mechanism between the air inlet and the pneumatic switch to solve the problem that the pneumatic switch of the electronic cigarette works continuously due to incorrect operations, and thus solve the problems shown in the prior art.

The present invention is realized by the following technical solutions. An electronic cigarette including a cartridge and a main body detachably connected to the cartridge. An end of the cartridge is provided with a drip tip for air outflow, and the other end of the cartridge is provided with an electrode. A bottom of the cartridge has an air inlet. The main body includes a circuit board, a pneumatic switch being provided at an upper end of the main body fitting with the air inlet, wherein the electrode contacts the circuit board for electric conduction when the cartridge is assembled with the main body, the pneumatic switch is turned on when an inhaling operation is performed, and the pneumatic switch is turned off when the inhaling operation is completed.

Preferably, an anti-blowback mechanism is arranged between the air inlet and the pneumatic switch.

Preferably, the anti-blowback mechanism comprises: a silicone valve; a plastic lock block; and the pneumatic switch; wherein the silicone valve is mounted at the air inlet of the cartridge and is secured to an oil tank base located at a bottom portion of the cartridge by the plastic lock block, when the inhaling operation is performed, the silicone valve is turned on, uncovering the air inlet of the cartridge, and when the inhaling operation is stopped, the air inlet is sealed by the silicone valve, isolating the air inlet from the pneumatic switch.

Preferably, the main body comprises: a battery housing; the circuit board; the pneumatic switch; a support, and a battery; wherein the support is mounted within the battery housing, the battery is mounted in a battery receiving groove in the support, the pneumatic switch is mounted in a pneumatic switch mounting groove located at the top of the support facing the air inlet, two conductive poles are soldered to the circuit board, the electrode located at the bottom of the cartridge contacts the two conductive poles for electric conduction, a side of the circuit board is provided with a switch button to turn on or turn off the electronic cigarette, the pneumatic switch is connected to the circuit board, and the battery supplies power to the circuit board and the cartridge.

Preferably, the cartridge comprises: an oil tank base; an oil tank; the electrode; and an oil injection hole plug, wherein, the oil tank base is mounted at the bottom of the oil tank, the oil tank base is provided with an oil injection hole, an oil storage chamber is provided within the oil tank, the oil injection hole is sealed by the oil injection hole plug, a top portion of the electrode extends into the oil tank base, with the top portion of the electrode being connected to an atomization assembly inside the oil tank, a bottom portion of the electrode is connected to the circuit board of the main body; and the air inlet is arranged at a lower end surface of the oil tank base.

Preferably, a detachable connection is formed between the cartridge and the main body.

Preferably, the atomization assembly comprises: an atomization chamber; an oil guide cotton; and a heating wire, wherein the air flow enters in from the air inlet of the cartridge and flows through an air passage, the heating wire and gets out of an air suction port of the drip tip, an tobacco oil in the oil tank flows to the oil guide cotton through an oil passage, an atomization chamber is formed by the structure of the air passage and the oil tank base, and the heating wire and the oil guide cotton are arranged inside the atomization chamber.

Preferably, the air inlet, the air passage and the air suction port are formed by the structures of the oil tank and the oil tank base of the cartridge.

Preferably, the oil tank and the oil tank base are assembled to form the cartridge, and the cartridge and the main body are assembled to form an integrated electronic cigarette.

The advantages of the present invention are as follows. In the present invention, the air inlet is provided with an anti-blowback mechanism, avoiding the switch from being triggered when the electronic cigarette is not in use, and thus the problems including cotton in the atomization chamber being burnt, the atomizer being damaged, and even worse the user being scalded due to the wrong operations can be solved.

BRIEF DESCRIPTION OF THE DRAWINGS

In order to clearly illustrate the embodiments of the present invention or the technical solutions in the prior art, the drawings required in the descriptions of the embodiments or the prior art will be briefly described hereinafter. It is apparent that the drawings described in the following description are merely some embodiments of the present invention, and other drawings may be derived from these drawings by those of ordinary skill in the art without creative efforts.

DESCRIPTION OF THE NUMERALS REFERENCES

1—silicone valve, 2—plastic block, 4—oil injection hole plug, 6—oil tank base, 7—oil tank, 8—electrode, 9—switch button, 10—battery housing, 13—circuit board, 14—pneumatic switch, 15—support, 16—battery, 17—air inlet, 18—drip tip, 19—battery receiving groove, 20—cartridge, 21—main body, 22—pneumatic switch mounting groove, 23—conductive poles.

DETAILED DESCRIPTION

All of the features, or steps of the methods or processes disclosed in this specification may be combined in any manner except for the features and/or steps that are mutually exclusive.

Any feature disclosed in this specification (including any additional claims, abstracts and drawings) may be replaced by other equivalents or substitute features directed to similar purposes unless there are specific statements. That is to say, unless otherwise stated, each feature is only one example of a series of equivalents or similar features.

Figure 1:
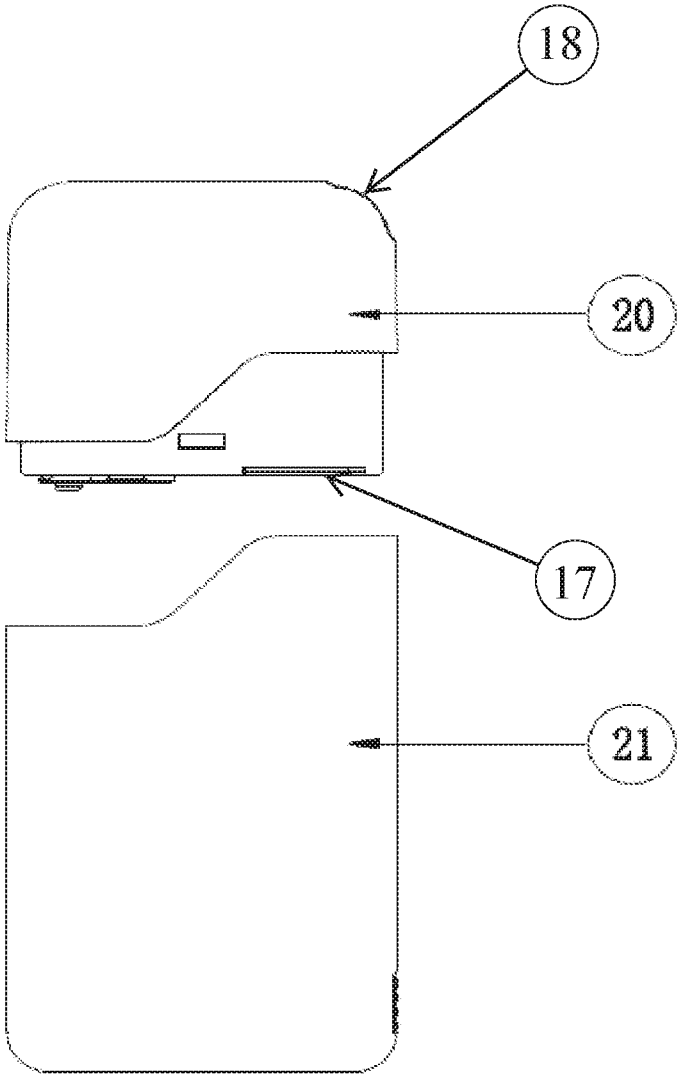
FIG. 1 is an assembled structural schematic view of the present invention.
Figure 2:
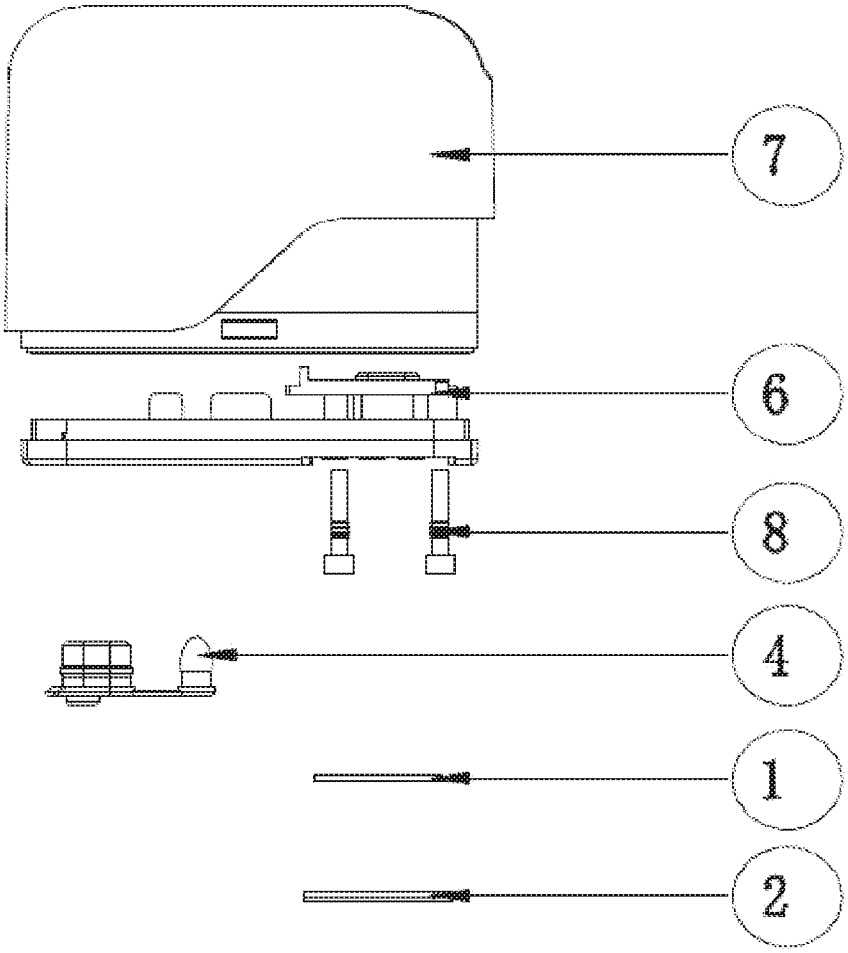
FIG. 2 is an exploded structural schematic diagram of the cartridge part of the present invention.
Figure 3:
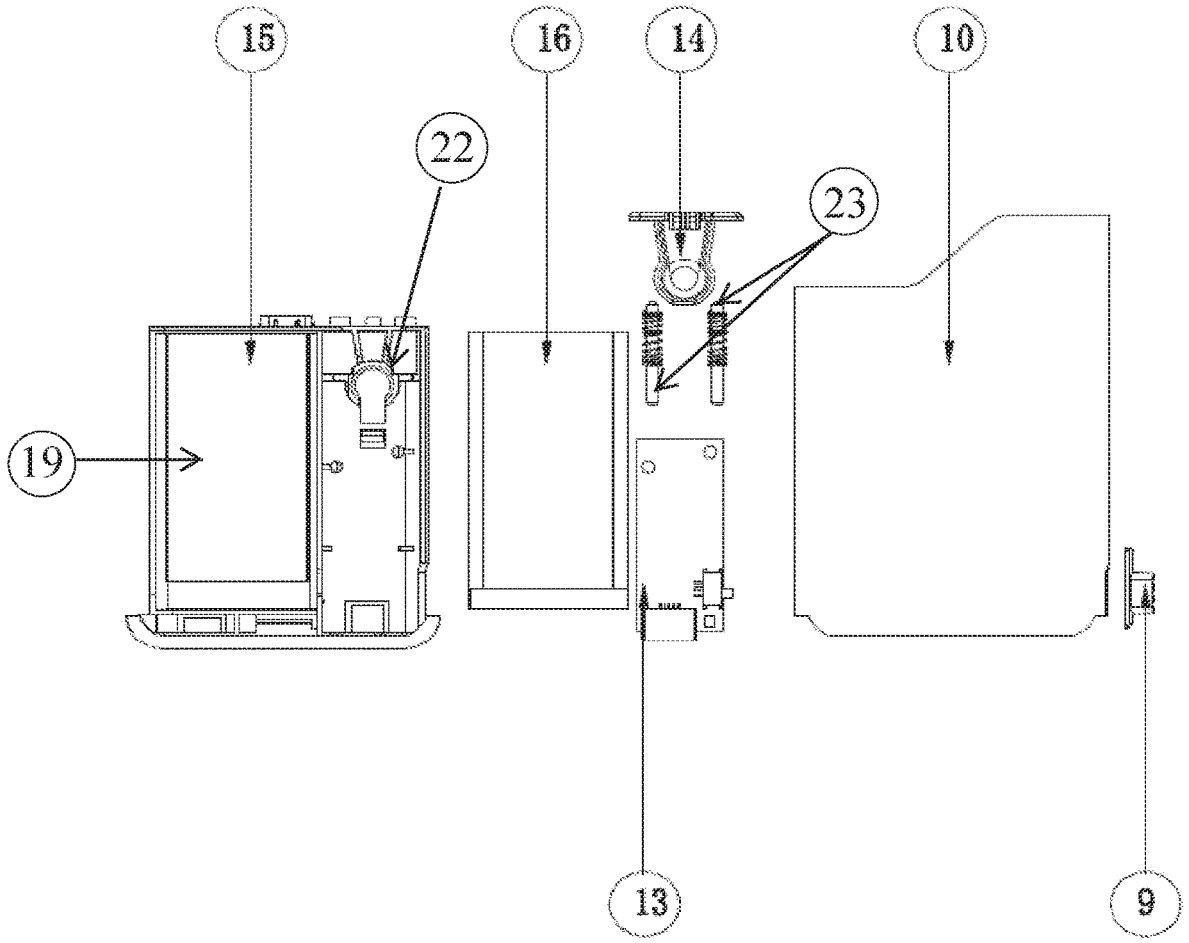
FIG. 3 is an exploded structural schematic diagram of the main body of the present invention.

Referring to FIGS. 1-3, the electronic cigarette includes two parts, a cartridge 20 and a main body 21, which can be detachably assembled together. One end of the cartridge 20 is provided with a drip tip 18 for air outflow, and the other end of the cartridge 20 is provided with an electrode 8. The electrode 8 contacts a circuit board 13 in the main body 21 for electric conduction when the cartridge 20 is assembled to the main body 21, so that the battery 16 supplies power to the cartridge 20 for heating.

The bottom of the cartridge 20 is provided with an air inlet 17. An upper end of the main body 21 that is fitted with the air inlet 17 is provided with a pneumatic switch 14. the pneumatic switch 14 is turned on when an inhaling operation is performed, and the pneumatic switch 14 is turned off when the inhaling operation is completed. This function is realized by using an anti-blowback mechanism which is arranged between the air inlet 17 and the pneumatic switch 14, so that when the inhaling operation is not performed, the air inlet 17 can be effectively sealed through the anti-blowback mechanism. Therefore, the series of problems indicated in the background that arises due to the incorrect operations can be avoided.

The structure mentioned above will be further described hereinafter. The above-mentioned anti-blowback mechanism includes a silicone valve 1, a plastic block 2 and a pneumatic switch 14. The silicone valve 1 is mounted at the air inlet 17 of the cartridge 20. The silicone valve 1 is mounted to an oil tank base 6 which is located at a bottom portion of the cartridge 20 by the plastic lock block 2. When the inhaling operation is performed, the silicone valve 1 will be turned on, uncovering the air inlet 17 of the entire cartridge 20. When the inhaling operation is stopped, the air inlet 17 will be sealed by the silicone valve 1, separating the air inlet 17 from the pneumatic switch 14.

In the present invention, the main body 21 includes a battery housing 10, a circuit board 13, a pneumatic switch 14, a support 15 and a battery 16. The support 15 is mounted inside the battery housing 10. The battery 16 is mounted in a battery receiving groove 19 in the support 15. The pneumatic switch 14 is mounted in a pneumatic switch mounting groove 22 located at the top of the support 15 facing the air inlet 17. Two conductive poles 23 are soldered to the circuit board 13. The electrode 8 located at the bottom of the cartridge 20 contacts the two conductive poles 23 for electric conduction. One side of the circuit board 13 is provided with a switch button 9 to turn on or turn off the electronic cigarette. The pneumatic switch 14 is connected to the circuit board 13, and the battery 16 supplies power to the circuit board 13 and the cartridge 20.

The cartridge 20 includes an oil tank base 6, an oil tank 7, electrodes 8, and an oil injection hole plug 4. The oil tank base 6 is mounted at the bottom of the oil tank 7. The oil tank base 6 is provided with an oil injection hole. An oil storage chamber is provided within the oil tank 7. The oil injection hole is sealed by the oil injection hole plug 4. The top portions of the electrodes 8 are inserted into the oil tank base 6, with the top portion of the electrodes 8 being connected to an atomization assembly inside the oil tank 7. The bottom portions of the electrodes 8 are connected to the circuit board 13 of the main body 21. The air inlet 17 is arranged at a lower end surface of the oil tank base 6.

Furthermore, a detachable connection is formed between the cartridge 20 and the main body 21. The atomization assembly includes an atomization chamber, an oil guide cotton and a heating wire. The air flow enters in via the air inlet 17 of the cartridge 20 and flows through an air passage, the heating wire and gets out of an air suction port of the drip tip 18. The tobacco oil in the oil tank 7 flows to the oil guide cotton through an oil passage. An atomization chamber is formed by the structures of the air passage and the oil tank base 6. The heating wire and the oil guide cotton are arranged inside the atomization chamber.

In the present embodiment, the air inlet 17, the air passage and the air suction port are formed by the structures of the oil tank 7 and the oil tank base 6 of the cartridge 20. The oil tank 7 and the oil tank base 6 are assembled to form the cartridge 20, and the cartridge 20 and the main body 21 are assembled to form an integrated electronic cigarette.

When the user is to smoke, the switch button 9 of a power source needs to be turned on, to power the heating wire in the atomization chamber 7 and thus atomizing the tobacco oil. The air flow enters the cartridge 20 from the air inlet 17 and flows through the air passage, the heating wire and at last gets out from the air suction port of the drip tip 18. When the inhaling operation is completed, the pneumatic switch 14 stops outputting, namely, the heating system stops operating.

When the user is smoking, the valve is open, allowing the gas to get into the atomization chamber normally. When the user stops smoking, the valve is restored to prevent gas from getting into the oil tank base 6 through the air inlet 17, avoiding the pneumatic switch 14 from being triggered which may render the cartridge 20 out of control, which causes the cotton being over burnt, the atomizer being damaged, and even worse the user being scalded.

The advantages of the present invention are as follows. In the present invention, the air inlet 17 is provided with an anti-blowback mechanism, avoiding the switch from being triggered when the electronic cigarette is not in use, and thus the problems such as the cotton in the atomization chamber being over burnt, the atomizer being damaged, and even worse the user being scalded due to the in correct operations can be solved.

The above description is merely some specific embodiments of the present invention. However, the protection scope of the present invention is not limited thereto. Any variation or substitution derived from the present invention without creative efforts falls within the protection scope of the present invention. Accordingly, the protection scope of the present invention should be based on the protection scope defined by the appended claims.

What is claimed is:

1. An electronic cigarette, comprising:

a cartridge, an end of the cartridge being provided with a drip tip for air outflow, and the other end of the cartridge being provided with an electrode, a bottom of the cartridge having an air inlet; and a main body detachably connected to the cartridge, the main body comprising a circuit board, a pneumatic switch being provided at an upper end of the main body, the pneumatic switch being configured to fit with the air inlet;

wherein the electrode is configured to contact the circuit board for electric conduction when the cartridge is assembled with the main body, the pneumatic switch is turned on when an inhaling operation is performed through the drip tip, and the pneumatic switch is turned off when the inhaling operation is completed, wherein an anti-blowback mechanism is arranged between the air inlet and the pneumatic switch, wherein the anti-blowback mechanism comprises:

a silicone valve;

a plastic lock block; and the pneumatic switch, wherein the silicone valve is configured to be mounted at the air inlet of the cartridge and is configured to be secured to an oil tank base located at the bottom of the cartridge by the plastic lock block, when the inhaling operation is performed through the drip tip, the silicone valve is configured to be open to uncover the air inlet of the cartridge, and when the inhaling operation is stopped, the air inlet is configured to be sealed by the silicone valve to isolate the air inlet from the pneumatic switch.

2. An electronic cigarette, comprising:

a cartridge, an end of the cartridge being provided with a drip tip for air outflow, and the other end of the cartridge being provided with an electrode, a bottom of the cartridge having an air inlet; and a main body detachably connected to the cartridge, the main body comprising a circuit board, a pneumatic switch being provided at an upper end of the main body, the pneumatic switch being configured to fit with the air inlet;

wherein the electrode is configured to contact the circuit board for electric conduction when the cartridge is assembled with the main body, the pneumatic switch is turned on when an inhaling operation is performed through the drip tip, and the pneumatic switch is turned off when the inhaling operation is completed, wherein the main body comprises:

a battery housing;

the circuit board;

the pneumatic switch;

a support; and a battery, wherein the support is configured to be mounted within the battery housing, the battery is configured to be mounted in a battery receiving groove in the support, the pneumatic switch is configured to be mounted in a pneumatic switch mounting groove located at the top of the support facing the air inlet, two conductive poles are configured to be soldered to the circuit board, the electrode located at the bottom of the cartridge is configured to contact the two conductive poles for electric conduction, a side of the circuit board is provided with a switch button to turn on or turn off the electronic cigarette, the pneumatic switch is configured to be connected to the circuit board, and the battery is configured to supply power to the circuit board and the cartridge.

* * * * *